US005358819A

United States Patent [19]

Urata et al.

[11] Patent Number: 5,358,819

[45] Date of Patent: Oct. 25, 1994

[54] DEVELOPER FOR ELECTROPHOTOGRAPHY

[75] Inventors: Yoshinori Urata, Kashihara; Toshihisa Ishida, Nara; Norio Tateishi, Nabari; Shigeaki Tasaka, Nara; Naotaka Funayama, Tenri, all of Japan

[73] Assignee: Sharp Kabushiki Kaishi, Osaka, Japan

[21] Appl. No.: 47,649

[22] Filed: Apr. 13, 1993

[30] Foreign Application Priority Data

Apr. 20, 1992 [JP] Japan ..... 4-125333
Mar. 3, 1993 [JP] Japan ..... 5-042406

[51] Int. Cl.[5] ..... G03G 9/10
[52] U.S. Cl. ..... 430/108
[58] Field of Search ..... 430/108, 106.6

[56] References Cited

U.S. PATENT DOCUMENTS 4,629,673 12/1986 Osawa et al. ..... 430/106.6
5,108,862 4/1992 Kishimoto et al. ..... 430/106.6

FOREIGN PATENT DOCUMENTS 4-83264 3/1992 Japan .

*Primary Examiner*—John Goodrow
*Attorney, Agent, or Firm*—David G. Conlin; George W. Neuner

[57] ABSTRACT

The object of the invention is to provide a developer for electrophotography which may present stable charging properties and image density after a prolonged period of copying operations as well as have a long life. The object can be achieved by providing a developer for electrophotography, compounded of: a toner component; and a carrier component prepared from a ferrite powder mixture in total of 100 parts, consisting of 10 to 90 parts by weight of a ferrite powder having a specific surface range of 200 to 230 $cm^2/g$, and 10 to 90 parts by weight of a ferrite powder having a specific surface range of more than 230 to 300 $cm^2/g$.

1 Claim, 1 Drawing Sheet

DEVELOPER FOR ELECTROPHOTOGRAPHY

BACKGROUND OF THE INVENTION (1) Filed of the Invention

The present invention relates to a developer for electrophotography, and more particularly to improvement of a developer for electrophotography in its life and image stability.

(2) Description of the Related Art

Generally, as a developer for electrophotography there has been known two-component developer which is composed of a toner component that visualizes a static latent image on the photoconductor therewith, and a carrier component that generates charges by triboelectrification to impart the charges to the toner and serves to carry over the toner to development region.

With regard to such a two-component developer, the toner component typically is compounded of about 80 to 90% of binder resin, about 5 to 15% of a colorant, about 1 to 5% of electrification inhibitor, and some percent or less of surface lubricant and/or other additives.

On the other hand, with regard to the carrier, there are known iron powder type carriers, ferritic carriers and binder type carriers, etc. Of these, ferritic carriers are widely used. These ferritic carriers are generally coated with resin by spraying, immersion or other techniques. Examples of such resins for coating include polyester resins, fluorine-contained resins, acrylic resins and silicone resins, etc., and one or more kinds of resins are used for this purpose.

Meanwhile, if a developer, and therefore, its carriers also, has undergone repeated copying operations, the coatings of such carriers generally tend to be peeled off, and to make matters worse, the toner particles are liable to adhere or stick to the carriers due to forces except those caused by charges, for example, by mechanical forces. These phenomena cause, for example, the image density to extremely lower, thus presenting a great difference or degradation to the total image features, compared to images copied when the developer was fresh.

In view of shape and feature of carrier particle itself, when cores of carrier particles has smaller specific surfaces, the surface of the core particle is relatively smooth. Therefore, coating made on such a core becomes so soft and delicate without much toughness, that the coating is easy to be peeled away in the agitation process. Accordingly, resistance of the total developer lowers, and even if the developer is highly charged, the charges will leak away. For this reason, the charging condition and the image density are stabilized while the life is disadvantageously short.

In contrast, a carrier for electrostatic charge development with a core member having a large specific surface has been proposed in, for example, Japanese Patent Application Laid-Open hei-4 No. 83264. The carrier disclosed is designed to improve resistance of the carrier to pollution, and comprises a core member of irregular ferrite with a specific surface of 300 $cm^2/g$ or more, and fluoro-resin mainly containing monomer vinylidene fluoride coated thereon. Carriers with a core having such a great specific surface form a firm coating thereon, since the core particle is complicatedly jagged. Accordingly, repeated agitations will not make the coating peel away, as compared with the case where cores have a smaller specific surface. Therefore, the life of the carrier is prolonged while the developer is highly charged to disadvantageously make the image unstable and its image density low.

Thus, in the case where the same developer is used repeatedly over a prolonged period of time, it is very difficult to achieve stable image density and, at the same time, make longer the life of the developer when a conventional developer is used for copying process. In other words, the object can be only achieved by a developer that contains carriers presenting stable charging properties and no deterioration of such as coat-peeling or the like.

SUMMARY OF THE INVENTION

It is therefore an object of the present invention to provide a developer for electrophotography which has a long life, and has a stable charging property and therefore exhibits stability in image density after the repeated copying operations over a long period of time.

The above object of the invention can be achieved by providing a developer for electrophotography, compounded of: a toner component; and a carrier component prepared from a ferrite powder mixture in total of 100 parts, consisting of 10 to 90 parts by weight of a ferrite powder having a specific surface range of 200 to 230 $cm^2/g$, and 10 to 90 parts by weight of a ferrite powder having a specific surface range of more than 230 to 300 $cm^2/g$.

A developer in accordance with the invention is formed by compounding a toner component together with a carrier component prepared from a mixture of two grades of ferrite powders having different specific surfaces, namely, a ferrite powder having a specific surface of 200 to 230 $cm^2/g$ and another ferrite powder having a specific surface of more than 230 to 300 $cm^2/g$. Accordingly, carrier particles prepared from the ferrite powder having larger specific surfaces is advantageous, as it allows formation of firm coating, to prolong the life of the developer, whereas carrier particles prepared from the ferrite powder having smaller specific surfaces contribute to stabilize charging properties of the developer and its image density. The combination of these effects allows the developer to achieve the intended object, that is, stabilization in charging properties and its image density over a prolonged period of copying operations and realization of long life.

DESCRIPTION OF THE PREFERRED EMBODIMENTS

Figure 1:
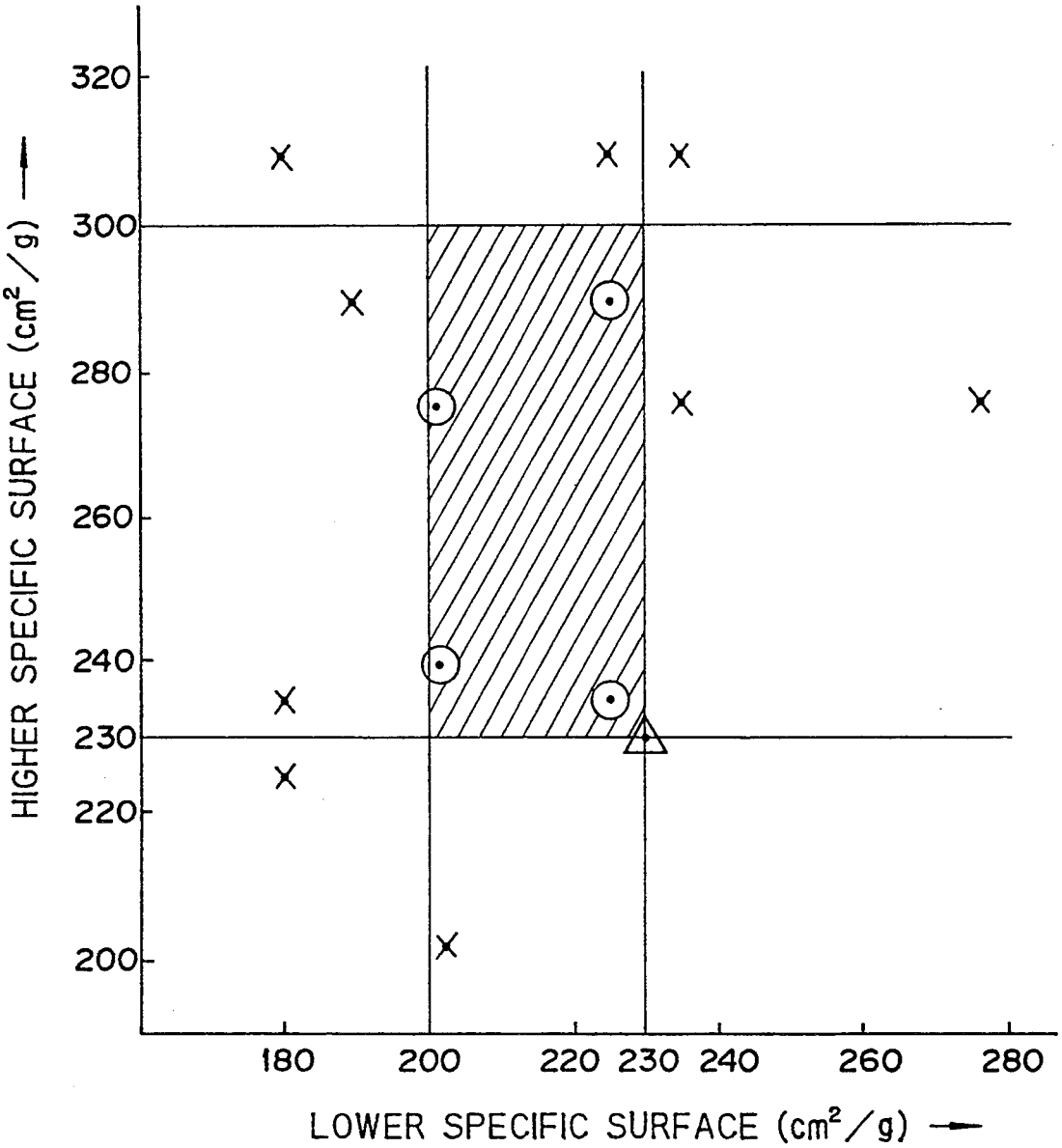
FIG. 1 is a chart for representing the effect of an embodiment according to the invention.

The present invention will hereinafter be described in detail with reference to the embodiments.

The term "specific surface" used in this specification is to represent surface area of ferrite powder particle per unit weight, and numeric values indicated for the specific surface in the invention are values compared under a premise that the ferrite powder particles are separated into a substantially constant grade.

The "ferrite powder" referred to in the invention indicates well known ferritic materials used as carriers for typical developer for electrophotography, and the ferrite powder used in the invention can be selected properly from these ferritic materials.

A reason for limiting a specific surface range for a ferrite powder having smaller specific surfaces within 200 to 230 $cm^2/g$ is that such a developer including the carriers with a ferrite powder core that falls within the range presents high initial image density when the developer is fresh, although the image density is lowered greatly after a prolonged period of time. In contrast to this, a developer using carriers with a ferrite core having a larger specific surface range, i.e. from more than 230 to 300 $cm^2/g$, presents little variation or deterioration of its image density even after a long term use, though the image density is low from the initial state when the developer is fresh.

Under consideration of these reasons, the present invention uses carriers prepared from the mixture of the both.

In this case, under assumption of a total of the both to be 100 parts by weight, if any one of these is contained in less than 10 parts by weight or in excess of 90 parts by weight, the combined effects to be brought by both the limitations of specific surface fade away. Accordingly, the properties and features to be brought by both the ferrite powders will lean to one side, so that no meaning of the combination use can be found out.

Finally, the present invention will be described more specifically, by comparing experimental data. Conditions of the experiments and means for measurement used are as follows.

(a) Measurement of specific surface

BET technique by means of Quantasorb made by YUASA IONICS Co., Ltd., Kr gas was used as absorption medium.

(b) Carrier silicone-coated carrier made by POWDER TECH KABUSHIKI KAISHA.

(c) Toner

A commercially distributed toner consisting of mainly, a binder resin, a colorant, a charge inhibitor, and a surface treating agent.

(d) Agitation and mixture for preparation of a developer

By using a NAUTA MIXER made by HOSOKAWA MICRON CORPORATION, a carrier (2000 g) prepared from a different combination of ferrite powder cores having two different specific surface ranges, and the toner (74.7 g) were blended to form a developer (the specific surfaces will be shown in additional tables).

(e) Continuous copying test

Evaluation of developers was carried out in four states, i.e., in the initial state (Ini), after 5,000 copies (5K), after 10,000 copies (10K), after 45,000 copies (45K) by using a copier SF7800 made by SHARP CORPORATION.

(f) Measurement of image density (ID)

Image density of a black-solid portion was measured in N-mode and P-mode using a density meter RD914 made by Macbeth Co.

(f-1) N-mode: normal copy mode (f-2) P-mode: photography-copy mode (Note) The difference in process of P-mode from N-mode is that the charging potential of photoconductor is low in P-mode. Accordingly, the black portion is lowered in density to present soft images, and therefore, the consumption of developer is reduced.

(g) Measurement of charge quantity (Q/M)

Use was made of a blow-off type powder charge measuring apparatus manufactured by TOSHIBA CHEMICAL CORPORATION. Q: charge (μC), M: adhered quantity of developer per unit area Under these conditions, the carrier shown in (b) was blended (by varying its proportion of carriers having different specific surfaces) with the developer in the way shown in (d), to execute various tests. Details of the specific surfaces and the result of the various measurement are shown in Table 1.

As shown in Table 1, with regard to comparative example 1 and 2, carriers prepared from a single grade of ferrite powder of a specific surface were used. The life of the carrier was short and deterioration of its charging properties and image density was observed in comparative example 1, in which a ferrite powder having a small specific surface was used. On the contrary, in comparative example 2, a ferrite powder having a large specific surface was used. The image density was stable over repeated operations, although the density was low on the whole.

On the other hand, in examples 1 and 2, two grades of ferrite powders having different specific surfaces each falling within the range specified by the invention were used in combination. As a result, a sufficient evidence of the effect of the invention was confirmed for either case of N-mode or P-mode.

TABLE 1

| | Specific Surface ($cm^2/g$) | | Copy Number Ini | 5K | 10K | 45K |
|---|---|---|---|---|---|---|
| Comparative Example 1 | 202 | ID N | 1.42 | 1.38 | 1.36 | 1.30 |
| | | P | 1.33 | 1.22 | 1.21 | 1.12 |
| | | Q/M | 8.5 (μC/g) | 10.1 | 11.2 | 9.0 |
| Comparative Example 2 | 276 | ID N | 1.35 | 1.33 | 1.32 | 1.30 |
| | | P | 1.24 | 1.22 | 1.22 | 1.18 |
| | | Q/M | 12.1 (μC/g) | 13.0 | 13.2 | 14.0 |
| Example 1 | 202 $cm^2/g$ × 800 g + 276 $cm^2/g$ × 1200 g | ID N | 1.40 | 1.39 | 1.39 | 1.38 |
| | | P | 1.32 | 1.31 | 1.30 | 1.29 |
| | | Q/M | 9.3 (μC/g) | 10.5 | 10.9 | 10.8 |
| Example 2 | 225 $cm^2/g$ × 600 g + 235 $cm^2/g$ × 1400 g | ID N | 1.41 | 1.40 | 1.38 | 1.37 |
| | | P | 1.30 | 1.28 | 1.27 | 1.25 |
| | | Q/M | 8.8 (μC/g) | 10.2 | 11.3 | 11.2 |

In order to show the effect of the invention more clearly, the similar tests as shown in Table 1 were executed and evaluated, each test using different two grades of carriers having different specific surfaces.

Upon evaluation, the initial image quality and the image quality after a long running of 45K copies (to be referred to as life image quality) were selected as evaluation matters and based on the evaluation result, comprehensive evaluation was performed.

Table 2 shows entire result of the tests. In Table 2, the initial image quality and the life image quality represent the image quality in N-mode operation at the beginning and after 45K copies, respectively, and the image quality was graded into three ranks, as shown in the foot note of the table. The comprehensive evaluation was also given by three ranks, namely "Good", "Medium" and "Bad".

Now referring to the developers in Table 2, the developers used in examples 1 and 2 are those of examples of the invention previously shown in table 1. The developers used in examples 3 and 4 are of embodiments of the invention and in each example, two grades of carriers having two different specific surface distributions are blended in a ratio of 1:1 to make the most preferable combination. In contrast, comparative examples 3 to 10 use developers below the standards of the invention. That is, all the combinations of the specific surfaces of carriers are without the scope of the invention, and such carriers are blended in a ratio of 1:1. Explicit values of specific surfaces for carriers used in the examples and comparative examples are shown in Table 2.

As shown in Table 2, with regard to comparative example 3, both the carrier having a lower specific surface and the carrier having a higher specific surface are lower than the respective lower limits specified by the invention, so that either of the initial image quality or the life image quality is unsatisfactory.

In the case of comparative example 4, the carrier of a higher specific surface is within the scope of the invention, but the carrier of a lower specific surface is lower than the lower limit of the invention. Accordingly, the initial image quality is poor, but the life image quality is stable as its own way.

Comparative example 5 uses a single component carrier having a specific surface of 230 $cm^2/g$ which corresponds to the boundary between the lower and higher specific surfaces of the invention. This example presents some stability in both the initial and the life image qualities as compared to the other comparative examples, but is inferior to the examples of the invention.

Next, referring to comparative example 6, the specific surface of carrier for a lower specific surface slightly exceeds the range of the invention, both the initial and the life image qualities are unsatisfactory as compared to the examples of the invention.

In the comparative example 7, the specific surface of carrier for a higher specific surface slightly exceeds the range of the invention, although the initial image quality is satisfactory, the fatigue of the carrier after the long running of copying operation is striking, so that the life is unsatisfactory.

In the case of comparative example 8, the carrier of a lower specific surface falls in a range below that of the invention, and the carrier of higher specific surface falls in a range above that of the invention. That is, both carriers are without scope of the invention. Accordingly, either the initial image quality or the life image quality is too bad to be allowable even for the prior art.

Also, in the case of comparative example 9, the both carriers for the lower and higher specific surfaces are above the scope of the invention, falling without the scope, the result is as bad as that of comparative example 8.

In the case of comparative example 10, like the case of comparative example 4, the carrier of a higher specific surface is within the scope of the invention, but the carrier of a lower specific surface is lower than the lower limit of the invention. Accordingly, the initial image quality is poor, but the life image quality is stable as its own way.

In contrast to these comparative examples, the examples 1 and 2 of the invention, as well as the newly shown examples 3 and 4, are all included within the scope of the invention. Accordingly, the initial image density (or image quality) is excellent for any of these examples, and the image density after a long running of copying operation (the life image quality) varies little as compared to the initial situation. Thus, it is apparent that no carrier fatigue occurs.

TABLE 2

| | Lower Specific Surface ($cm^2/g$) | Higher Specific Surface ($cm^2/g$) | Initial Image Quality | Life Image Quality | Cpmprehensive Evaluation |
|---|---|---|---|---|---|
| Comparative Examples | | | | | |
| 3 | 180 | 225 | Poor | Poor | Bad |
| 4 | 180 | 235 | Poor | Medium | Bad |
| 5 | 230 | 230 | Medium | Medium | Medium |
| 6 | 235 | 276 | Poor | Medium | Bad |
| 7 | 225 | 310 | Medium | Poor | Bad |
| 8 | 180 | 310 | Poor | Poor | Bad |
| 9 | 235 | 310 | Poor | Poor | Bad |
| 10 | 190 | 290 | Poor | Medium | Bad |
| Examples | | | | | |
| 1 | 202 | 276 | Good | Good | Good |
| 2 | 225 | 235 | Good | Good | Good |
| 3 | 225 | 290 | Good | Good | Good |
| 4 | 202 | 240 | Good | Good | Good |

(Note)
Initial Image Quality (Density)
Good 1.40 or more (N-mode)
Medium Less than 1.4 (N-mode)
Poor Less than 1.35 (N-mode)
Life Image Quality (Density) After 45K copies
Good 1.35 or more (N-mode)
Medium less than 1.35 (N-mode)
Poor less than 1.30 (N-mode)
Comprehensive Evaluation
Good
Medium
Bad Finally, the data shown in Tables 1 and 2 are summarized to present FIG. 1, which shows a plot representing the comprehensive evaluation of comparative examples 1 to 10 and examples 1 to 4, shown in Tables 1 and 2, by taking the higher specific surface as vertical axis and the lower specific surface as horizontal axis. In the figure, circle, triangle and cross represent "Good", "Medium" and "Bad" in the comprehensive evaluation.

As is apparent from FIG. 1, satisfactory evaluation is obtained for any point within the region enclosed by the range of from 200 to 230 $cm^2/g$ for the lower specific surface and by the of the range of from 230 to 300 $cm^2/g$ for the higher specific surface, while all the points without the region are evaluated as to be unsatisfactory.

As clear from the examples described above, according to the present invention, it is possible to provide a developer for electrophotography which has a long life, and may present a stable charging properties and therefore exhibit stability in its image density after a prolonged period of copying operations, and the effect of the invention is extremely striking.

What is claimed is:

1. A developer for electrophotography, compounded of:

a toner component; and a carrier component prepared from a ferrite powder mixture in total of 100 parts, consisting of 10 to 90 parts by weight of a ferrite powder having a specific surface range of 200 to 230 $cm^2/g$, and 10 to 90 parts by weight of a ferrite powder having a specific surface range of more than 230 to 300 $cm^2/g$.

* * * * *